US005408718A

United States Patent [19]

Sadovsky

[11] Patent Number: 5,408,718

[45] Date of Patent: Apr. 25, 1995

[54] COMBINATION CLEANING PAD

[76] Inventor: Shmuel Sadovsky, 24 Hayarden, Rishon Lezion, Israel

[21] Appl. No.: 120,486

[22] Filed: Sep. 14, 1993

[51] Int. Cl.[6] ..... A47L 13/16

[52] U.S. Cl. ..... 15/244.3; 15/118

[58] Field of Search ..... 15/104.93, 118, 244.3

[56] References Cited

U.S. PATENT DOCUMENTS

| | | | |
|---|---|---|---|
| 4,665,580 | 5/1987 | Morris | 15/118 |
| 4,821,360 | 4/1989 | Giallourakis | 15/244.3 |
| 4,949,417 | 8/1990 | Wertz | 15/118 |
| 5,187,830 | 2/1993 | Giallourakis | 15/244.3 |
| 5,227,844 | 7/1993 | Bhattacharjee | 15/104.93 |
| 5,331,705 | 7/1994 | Melou | 15/118 |

FOREIGN PATENT DOCUMENTS

| | | | |
|---|---|---|---|
| 988235 | 4/1965 | United Kingdom | 15/104.93 |

*Primary Examiner*—David A. Scherbel
*Assistant Examiner*—Terrence R. Till
*Attorney, Agent, or Firm*—Mark M. Friedman

[57] ABSTRACT

A cleaning pad, which is made up of a central core, typically a rectangular sponge, having two large parallel surfaces and a cover which is permanently connected, as by sewing, to the central core. The cover, which is typically woven, includes an abrasive portion and a non-abrasive portion, with the abrasive portion covering a portion of one of the large surfaces while the non-abrasive portion covers the rest of the large surface as well as the other large surface.

17 Claims, 1 Drawing Sheet

COMBINATION CLEANING PAD

FIELD AND BACKGROUND OF THE INVENTION

The present invention relates to cleaning pads such as might be used in the washing of dishes, silverware and pots, as well in other applications.

A variety of pads are commercially available for use in the washing of dishes, silverware, pots and pans, and in other domestic as well as non-domestic applications. The pads are typically made of, or include, a sponge or sponge-like material, typically synthetic.

It has long been recognized that, in many applications it is desirable to use two or more pads, each with different cleaning characteristics. For example, in washing dishes, a conventional soft sponge-like pad may be ideally suited for cleaning slightly soiled silverware and plates but may be insufficiently abrasive to adequately clean pots or pans. To clean pots or pans it is often necessary to use a second pad, such as a steel wool pad, and the like.

In an effort to overcome the inconvenience of using two different pads, there have been a number of attempts to develop dual pads which permanently combine two types of materials in a single pad. Illustrative of such attempts are the pad disclosed in U.S. Pat. No. 2,906,643 which is a composite cellular structure made up of a polyurethane foam layer chemically bonded to a layer of regenerated cellulose sponge. A similar pad is disclosed in U.S. Pat. No. 3,377,643. U.S. Pat. No. 2,804,728 discloses a sponge having one face over which a mesh of an abrasive material is partially embedded. U.S. Pat. No. 2,885,703 discloses a similar pad.

A common feature of the presently known pads is that in each case the two materials making up the pad are connected to each other in such a way that, when the pad is used, the hand of the user must ordinarily come in contact with both materials. Such contact is normally undesirable since one of the two materials is typically abrasive and uncomfortable to the touch.

There is thus a widely recognized need for, and it would be highly advantageous to have, a pad for use in washing dishes and the like which includes a relatively soft portion and a relatively abrasive portion and which is configured so that the hand of the user need not come in contact with the abrasive portion.

SUMMARY OF THE INVENTION

According to the present invention, there is provided a cleaning pad, comprising: (a) a central sponge core having two substantially parallel large surfaces; (b) a cover permanently connected about the central core, the cover including a woven abrasive portion and a woven non-abrasive portion, the abrasive portion covering a portion of one of the large surfaces while the non-abrasive portion covers the rest of the large surface and the other of the large surfaces.

According to further features in preferred embodiments of the present invention described below, the central core is a rectangular sponge.

According to still further features in the described preferred embodiments, the cover is made by weaving a first material, preferably polyester onto a second material, preferably a polyethylene netting.

The present invention successfully addresses the shortcomings of the presently known configurations by providing a pad for use in the washing of dishes and for other domestic and commercial applications which features at least one abrasive region suitable for heavy-duty applications, the pad being characterized in that it can be grasped and used by the user without the need for the user's hand to come in contact with the abrasive region.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a combination cleaning pad which can be used, for example, to wash plates and silverware as well as to scour pots and pans, and the like, yet which does not force the user to directly contact the abrasive portion of the pad.

The principles and operation of a pad according to the present invention may be better understood with reference to the drawings and the accompanying description.

Figure 1:
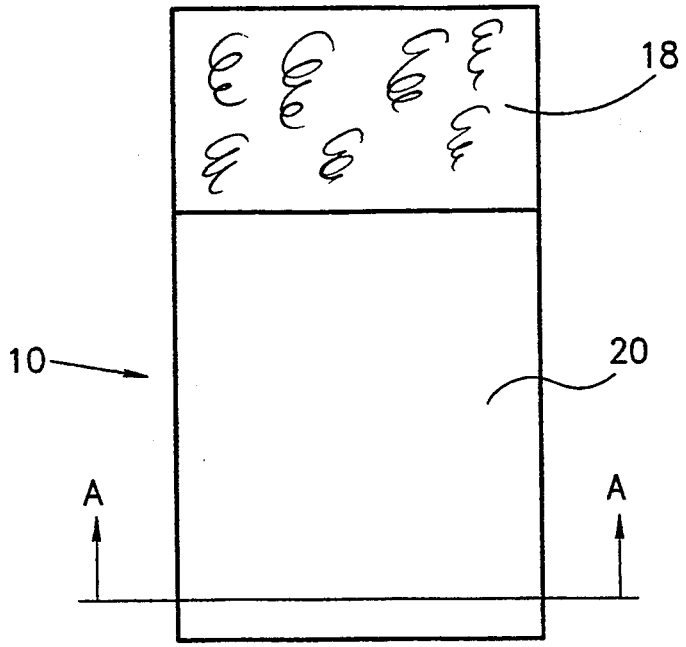
FIG. 1 is a front view of an illustrative pad according to the present invention showing the abrasive regions and a portion of the non-abrasive region.
Figure 2:
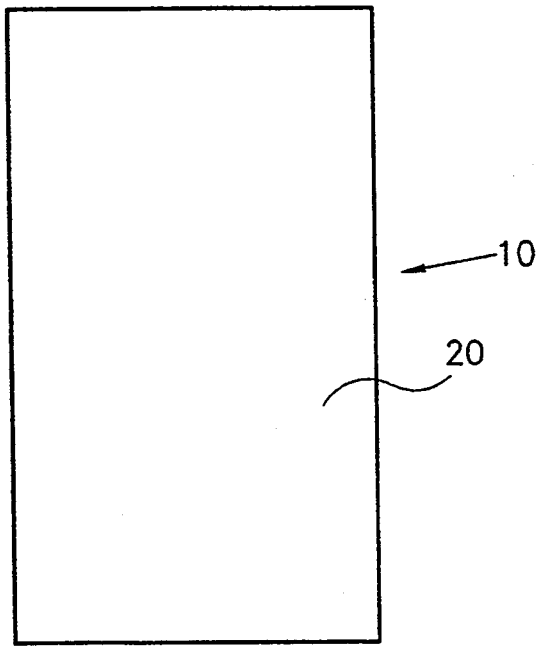
FIG. 2 is a back view of the pad of FIG. 1 which is entirely non-abrasive.
Figure 3:
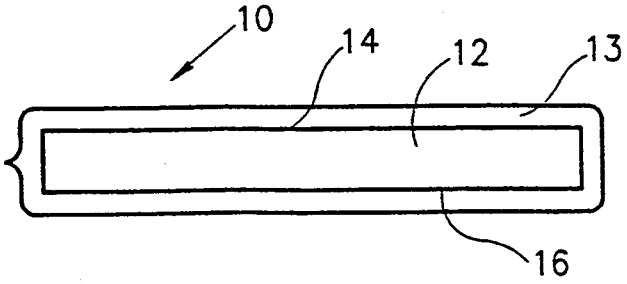
FIG. 3 is a cross-sectional view along section line a—a of FIG. 1.

Referring now to the drawings, FIG. 1 and 2 illustrate the front and back faces, respectively, of a pad 10 according to the present invention, with FIG. 3 showing a typical cross section of pad 10. Pad 10 includes a central core 12 (FIG. 3) having two substantially parallel large surfaces, 14 and 16 (FIG. 3). Preferably, core 12 is rectangular in shape with a width which is significantly smaller than its dimensions in the planes of large surface, 14 and 16.

Preferably, core 12 is a sponge, natural or artificial, or a sponge-like material, all of which are herein referred to individually and collectively as "sponge" or "sponges".

Permanently connected about core 12, preferably by completely surrounding core 12 and then sewing it to itself, as with suitable thread, to form a pocket-like structure, is a cover 13. Cover 13 features two regions—a relatively abrasive region (hereinafter "abrasive portion") 18 and a less abrasive region (hereinafter "non-abrasive portion") 20.

Abrasive portion 18 covers a part of one of the large surfaces, 14 or 16, of core 12, while non-abrasive portion 20 covers the rest of the large surfaces, 14 and 16. Preferably, neither abrasive portion 18 nor non-abrasive portion 20 is made of materials which can scratch or otherwise damage the objects to be cleaned, such as glass, metal or various coating, such as Teflon or enamel.

Preferably, abrasive portion 18 of cover 13 adjoins at least one of the edges of large surfaces, 14 or 16 (FIG. 1), preferably the shorter of the two edges of large surfaces, 14 or 16. Preferably, abrasive portion 18 of cover 13 overlies between about 10 and about 60 percent of the surface area of one of large surfaces, 14 or 16. Most preferably, abrasive portion 18 overlies between about 20 and about 35 percent of the surface area of one of the large surfaces, preferably.

Cover 13 may be made of any suitable material or combination of materials. Preferably, cover 13 is woven using a suitable polymer, most preferably using a pair of suitable polymers, with one material being woven onto a second material, which is preferably in the form of netting. Preferably, the netting is polyethylene while the material woven onto the netting is polyester. The netting may be made of polyethylene strips of suitable width and thickness.

The polyester strips may be of various widths and thicknesses. Preferably the polyester strips used as part of abrasive portion 18 of cover 13 have a width of from about 1.0 to about 2.5 mm, most preferably from about 1.5 to about 2.0 mm. Preferably the polyester strips used as part of abrasive portion 18 of cover 13 have a thickness of from about 50 to about 100 microns, most preferably from about 65 to about 80 microns.

Preferably the polyester strips used as pan of non-abrasive portion 20 of cover 13 have a width of from about 0.6 to about 1.0 mm, most preferably from about 0.7 to about 0.9 mm. Preferably the polyester strips used as pan of non-abrasive portion 20 of cover 13 have a thickness of from about 15 to about 40 microns, most preferably from about 20 to about 30 microns.

The weaving of cover 13 may be effected using any convenient means, including through use of a suitable weaving machine, including, but not limited to weaving machines manufactured by Karl Mayer of Frankfurt, Germany.

In use, the user would grasp a pad according to the present invention with a single hand. The user's thumb would be placed on one of faces, 14 or 16, while three or four of the user's fingers would be located on the opposing face. Because of the geometry of the pad, none of the user's fingers need come in contact with the abrasive portion 18 of pad 10.

For example, to scour pots or pans, the user would grasp the pad so that his thumb is located on the non-abrasive portion of the front face of the pad while his other fingers would be placed on the non-abrasive back face of the pad directly behind the abrasive portion so as to enable the user to apply direct pressure during the cleaning operation and thereby enhance the cleaning efficiency.

When washing plates, and other easy to clean objects not requiring scorning, the user could grasp the pad in a variety of fashions to facilitate contact between the plate and the non-abrasive face of the pad without any of the user's fingers contacting the abrasive portion of the pad.

While the invention has been described with respect to a limited number of embodiments, it will be appreciated that many variations, modifications and other applications of the invention may be made.

What is claimed is:

1. A cleaning pad, comprising:

(a) a central sponge core having two substantially parallel large surfaces;

(b) a cover permanently connected about said central core, said cover including a woven abrasive portion and a woven non-abrasive portion, said abrasive portion covering a portion of one of said large surfaces while said non-abrasive portion covers the rest of said large surface and the other of said large surfaces.

2. A pad as in claim 1, wherein said central core is rectangular.

3. A pad as in claim 1, wherein said core and said cover are permanently connected by sewing.

4. A pad as in claim 1, wherein said cover is made by weaving a first material onto a netting of a second material.

5. A pad as in claim 4, wherein said second material is polyethylene.

6. A pad as in claim 4, wherein said first material is polyester.

7. A pad as in claim 4, wherein said abrasive portion of said cover is formed with a first material of a width of between about 1.0 and about 2.5 mm.

8. A pad as in claim 4, wherein said abrasive portion of said cover is formed with a first material of a width of between about 1.5 and about 2.0 mn.

9. A pad as in claim 4, wherein said non-abrasive portion of said cover is formed with a first material of a width of between about 0.6 and about 1.0 mm.

10. A pad as in claim 4, wherein said non-abrasive portion of said cover is formed with a first material of a width of between about 0.7 and about 0.9 mm.

11. A pad as in claim 4, wherein said abrasive portion of said cover is formed with a first material of a thickness of between about 50 and a about 100 microns.

12. A pad as in claim 4, wherein said abrasive portion of said cover is formed with a first material of a thickness of between about 65 and about 80 microns.

13. A pad as in claim 4, wherein said non-abrasive portion of said cover is formed with a first material of a thickness of between about 15 and about 40 microns.

14. A pad as in claim 4, wherein said non-abrasive portion of said cover is formed with a first material of a thickness of between about 20 and about 30 microns.

15. A pad as in claim 1, wherein said abrasive portion of said cover adjoins at least one of the edges of said one of said large surfaces.

16. A pad as in claim 1, wherein said abrasive portion of said cover overlies between about 10 and about 60 percent of the surface area of said one of said large surfaces.

17. A pad as in claim 1, wherein said abrasive portion of said cover overlies between about 20 and about 35 percent of the surface area of said one of said large surfaces.

* * * * *